US006016786A

United States Patent [19]

Rodriquez-Amaya et al.

[11] Patent Number: 6,016,786

[45] Date of Patent: Jan. 25, 2000

[54] FUEL INJECTION SYSTEM

[75] Inventors: Nestor Rodriquez-Amaya; Stephan Jonas, both of Stuttgart, Germany

[73] Assignee: Robert Bosch GmbH, Stuttgart, Germany

[21] Appl. No.: 09/117,340

[22] PCT Filed: Jul. 2, 1997

[86] PCT No.: PCT/DE97/01380

§ 371 Date: Jan. 6, 1999

§ 102(e) Date: Jan. 6, 1999

[87] PCT Pub. No.: WO98/23858

PCT Pub. Date: Jun. 4, 1998

[30] Foreign Application Priority Data

Nov. 25, 1996 [DE] Germany ..... 196 48 690

[51] Int. Cl.[7] ..... F02B 3/00; F02M 37/04

[52] U.S. Cl. ..... 123/299; 123/506

[58] Field of Search ..... 123/506, 299, 123/300, 450, 449

[56] References Cited

U.S. PATENT DOCUMENTS

| | | | |
|---|---|---|---|
| 3,439,655 | 4/1969 | Eyzat | 123/300 |
| 3,698,373 | 10/1972 | Nagasawa | 123/300 |
| 4,470,760 | 9/1984 | Jarrett et al. | 123/300 |
| 4,838,232 | 6/1989 | Wich | 123/506 |
| 4,962,743 | 10/1990 | Perr et al. | 123/508 |
| 5,343,845 | 9/1994 | Fehlmann | 123/449 |

*Primary Examiner*—Thomas N. Moulis

*Attorney, Agent, or Firm*—Edwin E. Greigg; Ronald E. Greigg

[57] ABSTRACT

A fuel injection system having a high pressure fuel injection pump whose high-pressure pumping is determined by an electrically controlled valve that controls a relief conduit, and the phase of the fuel injection is determined by the closure of this valve. To execute an injection that is subdivided into a preinjection and a main injection, and to simplify triggering of the electrically controlled valve, a cam that drives the pump piston is shaped such that the cam furnishes a range (P), in which the pump piston, to interrupt the injection between the preinjection and the main injection, remains in or moves back to its then-reached position.

4 Claims, 2 Drawing Sheets

FUEL INJECTION SYSTEM

PRIOR ART

The invention is based on a fuel injection system.In one such system, known from German Patent Application DE-A 36 44 257, a distributor injection pump is provided as the fuel injection pump, with a reciprocatingly driven and at the same time rotating pump piston, which upon its rotary motion and in its pumping stroke in each case supplies one of a plurality of injection lines, each leading to one fuel injection valve, with fuel brought to injection pressure. To subdivide the injection into a preinjection and a main injection, the electrically controlled valve, which is a magnet valve, is briefly opened, so as to relieve the pump work chamber and briefly reduce the fuel pressure attained. This means that a very fast-switching magnet valve is needed, which involves considerable effort and expense for its electrical control and for the construction of the valve. In particular, a special pressure valve is provided in the connection between the pump work chamber and the injection valve as well; it opens in the supply direction during high-pressure fuel pumping to the fuel injection nozzle and closes upon termination of the injection and is suitable for reducing pressure waves between the pressure valve and the fuel injection valve and in this range of keeping a constant static pressure sought during the intervals between injections. It is advantageous, in the case of a subdivided fuel injection with one preinjection and one main injection per operating stroke of the respective cylinder to be supplied in the internal combustion engine, to assure a constant static pressure in the intervals between injections.

ADVANTAGES OF THE INVENTION

By means of the embodiment according to the invention, it becomes substantially simpler to control an injection that is subdivided into a preinjection and a main injection. Because the interruption is structurally dictated by way of the cam shape, an electrical control with an intermediate opening and reclosure of the electrically controlled valve in order to interrupt the injection between the preinjection and the main injection, and the attendant effort and expense, are dispensed with. Nor does the electrically controlled valve need the high switching speed that is required for exact control of the interval between a preinjection and a main injection, and the electrically controlled valve can be considerably simpler and smaller especially than a very fast-switching valve.

BRIEF DESCRIPTION OF THE DRAWINGS

One exemplary embodiment of the invention is shown in the drawing and will be described in further detail in the ensuing description.

DETAILED DESCRIPTION

Figure 1:
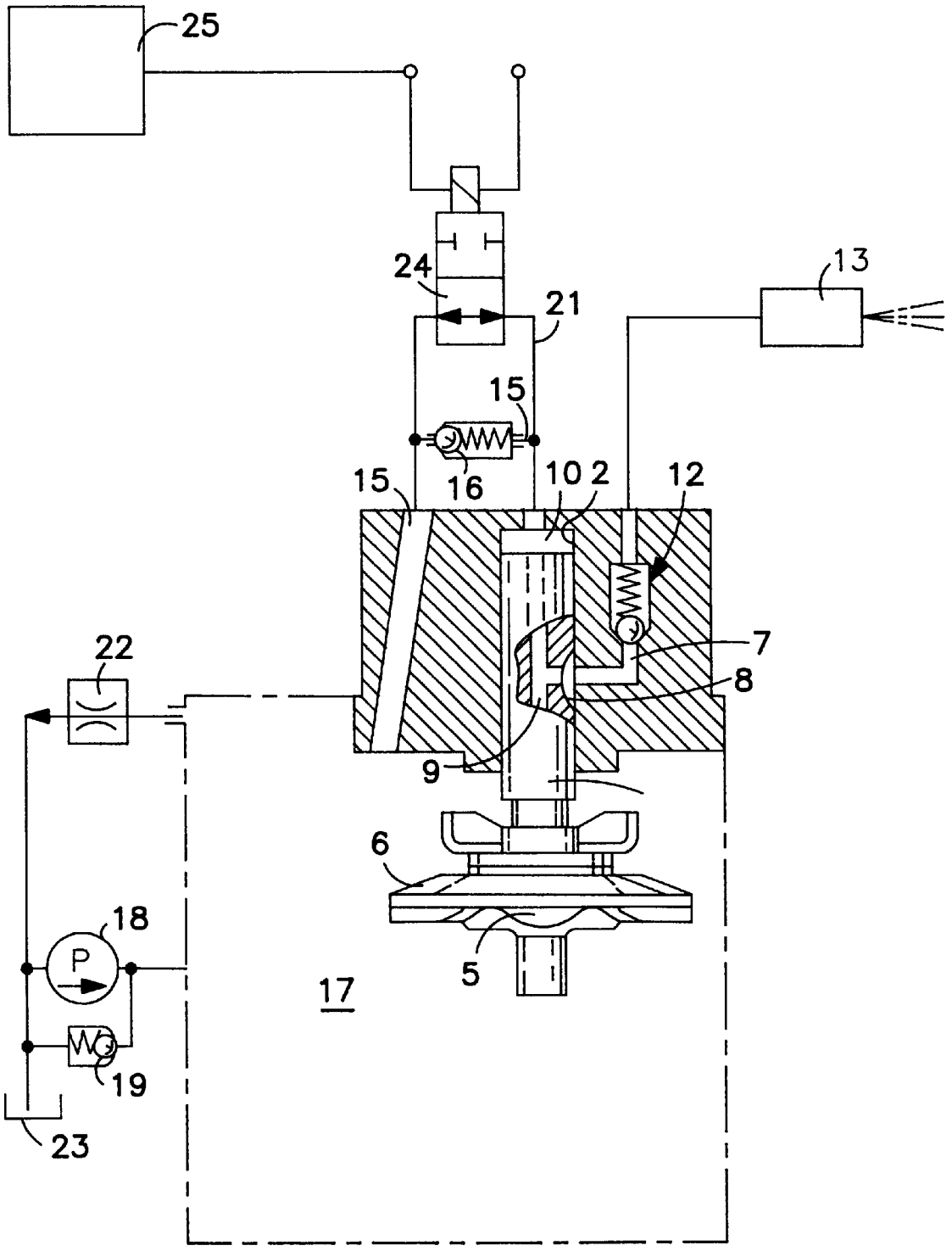
FIG. 1 is a basic illustration of a fuel injection pump which is controlled by a magnet valve.

The embodiment according to the invention is realized, in the exemplary embodiment described below, in terms of a distributor injection pump of the kind schematically shown in FIG. 1. This is a distributor injection pump of the axial piston type, but the subject of the invention is also applicable to other fuel injection pumps, such as distributor injection pumps of the radial piston pump type, or individual pumps with only a single pump piston to supply a single cylinder of an internal combustion engine, or in-line pumps. Nevertheless, the injection is especially advantageously realizable in a distributor injection pump, because then to supply the injection valves only a single electrically controlled valve is required, and the distribution to the individual injection valves is done with the aid of the distributor. In the distributor injection pump of the type shown in FIG. 1, a pump piston 1 is provided, which is disposed displaceably and rotatably in a cylinder bore 2 and there on the face end encloses a pump work chamber 10. The pump piston is coupled, for instance via a spring not otherwise shown, to a cam disk 6, which has axially downward-pointing cams 5 embodied according to the invention. The cam disk is driven to rotate, in particular in synchronism with the rpm of the engine supplied by the injection pump, in a known way by a drive shaft not shown in further detail; under the influence of the spring, the cam disk rolls along a known, axially stationary roller ring and consequently sets the rotating pump and distributor piston into a reciprocating feeding and aspirating motion. In its rotary motion in association with a pump supply stroke, in which fuel is positively displaced at high pressure out of the pump work chamber 10, the pump piston comes to communicate with one of a plurality of injection lines 7 via a distributor groove 8 in the jacket face of the pump and distributor piston. The distributor groove communicates constantly with the pump work chamber via a longitudinal-conduit 9. The injection line leads via a pressure valve 12 to a fuel injection valve 13, which is assigned to the respective cylinder of an engine.

The supply of fuel to the pump work chamber 10 is effected via an intake line 15, which supplies fuel from a suction chamber 17, which is essentially shown only in dashed lines and is enclosed inside the housing of the fuel injection pump. The suction chamber contains fuel from a fuel feed pump 18, which is driven in synchronism with the fuel injection pump, for instance by the drive shaft, and thus pumps fuel in rpm-dependent quantities into the suction chamber. With the aid of an additional pressure control valve 19, the pressure in the suction chamber is conventionally controlled as a function of rpm, if additional functions of the fuel injection pump are to be controlled with the aid of this pressure. Via an overflow throttle 22, fuel constantly flows back to the tank 23, thereby making provision for cooling the injection pump or degassing the suction chamber. The intake line 15 leads into the pump work chamber via a check valve 16, and the check valve opens in the direction of the pump work chamber. Provided parallel to this check valve is an electrically controlled valve 24, which controls a bypass line 21 around the pressure valve 16 and with the aid of which, upon opening of the valve, a communication is established between the pump work chamber 10 and the suction chamber 17 and the pump work chamber 10 is closed upon closure of the valve. The electrically controlled valve 24, symbolically represented as a magnet valve, is controlled in a manner known per se in accordance with operating parameters by a control unit 25. If the flow cross section of the valve 24 is sufficiently large, however, the check valve 16 may also be omitted. In that case, the pump work chamber is filled in the intake stroke solely by way of the electrically controlled valve.

With the aid of this electrically controlled valve, the onset of high-pressure pumping of the pump piston is controlled in such a way that in the final analysis the injection onset is likewise controlled with the aid of this valve. Upon closure, injection pressure builds up in the pump work chamber 10 and is delivered via the longitudinal conduit 9 and the distributor groove 8 to one of the injection lines 7. When the electrically controlled valve reopens, the high-pressure pumping is interrupted, so that the closing time of the valve determines the instant of injection and the injection quantity. By means of this valve, a preinjection can now be realized as well without special triggering.

Figure 2:
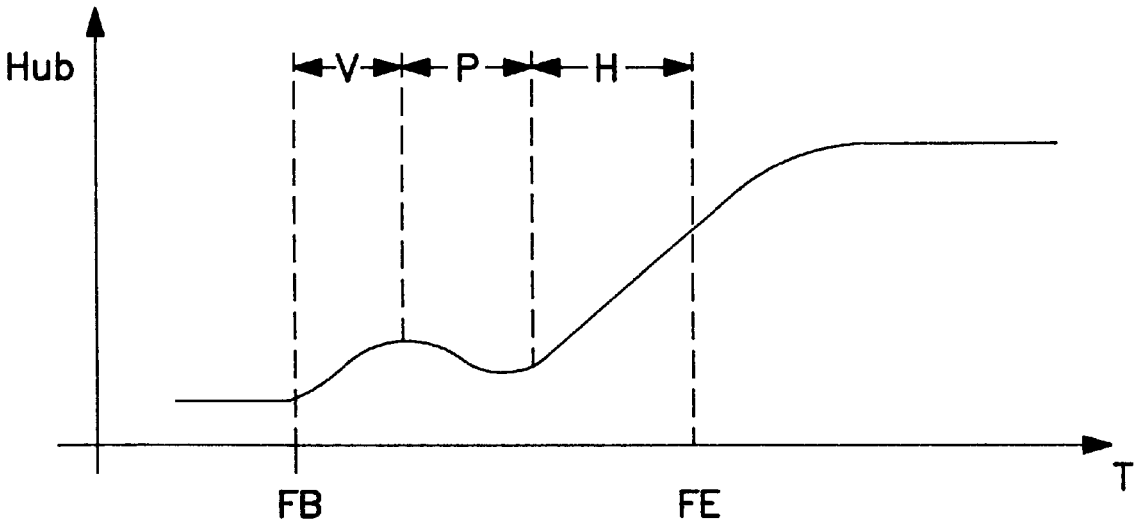
FIG. 2 shows a course of the cam path according to the invention, in the form of a cam rise curve over the rotary angle.

According to the invention, the pumping sides of the cam flanks of the cams 5 are embodied such that, as shown in FIG. 2, they generate a stroke course of the pump piston over time that is subdivided into a first range V, which begins with the supply stroke of the piston and ends after a short supply stroke; a second range P, in which the piston is then set into a reverse motion, so that high-pressure pumping is thus effectively terminated and an interval between injections ensues; and finally a third range H, in which the cam flank rises again and displaces the pump piston for the sake of further pumping of the main injection quantity.

It can also be seen from the graph in FIG. 2 how the electrically controlled valve, for instance a magnet valve or a piezoelectrically actuated valve, to control the onset of the preinjection quantity pumping and thus at the same time the onset of injection, is closed at point FB and is not opened again, to terminate the main injection, until point FE. The interruption of the injection is effected solely by the fact that no effective high-pressure pumping is possible through the cam range P. With this structurally dictated interval between injections, the duration of the interruption of the high-pressure injection can be done in principle with cam angles that are kept constant, and in particular that are independent of the switching speed of the electrically controlled valve and of the rpm. In individual cases it is also possible to modify the shape of the cam in view of the intended subdivided injection. Instead of causing a reverse stroke motion of the piston, the piston can also merely remain in its position or be moved onward only slightly that its motion does not suffice to enable any significant injection, in such a way than an effective interval between injections ensues that reduces the overall fuel supply to the engine combustion chamber such that the pressure rise in the combustion chamber becomes less, thus making it possible to attain low-noise combustion.

Advantageously, the fuel injection pump of the type according to the invention supplies injection valves that are suitable to inject at a subdivided injection rate and that thus furnish a smaller injection cross section for the preinjection than for the main injection. Such injection valves are known and need not be described further here. Reference may be made for instance to German Patent DE 36 06 246 C2. With the aid of injection valves embodied in this way, the requisite interval between the preinjection and the main injection can essentially be maintained even more exactly.

The foregoing related to a preferred exemplary embodiment of the invention, it being understood that other variants and embodiments thereof are possible wihtin the spirit and scope of the invention, the latter being defined by the appended claims.

We claim:

1. A fuel injection system, comprising a fuel injection pump with a pump work chamber (10) defined by a pump piston, said pump piston is driven by a cam drive provided with at least one cam, said pump work chamber serves to supply at least one fuel injection valve (13) with injection quantities of fuel brought to injection pressure during an intake stroke, said injection valve aspirates fuel by way of a suction line (15) for filling the pump work chamber (10), and an electrically controlled valve (24) by way of which the pump work chamber (10) of the fuel injection pump, during a supply stroke of the pump piston is made to communicate with a relief chamber (17) in which the pump piston displaces the fuel from the pump work chamber or the electrically controlled valve is closed in order to control the injection quantity and the instant of injection, and having an interruption of the injection between one preinjection and one main injection per injection event, the at least one cam is embodied such that on a cam flank that causes the pump piston to execute a pumping stroke, that at least one cam has a partial range (P) in which the piston (1), after a first supply stroke for the preinjection, remains at least in its then-reached position in order to interrupt the high-pressure supply stroke, or reverses the stroke, and then, for performing the supply stroke for the main injection, is moved onward, the electrically controlled valve (24) being controlled such that at an onset of the supply stroke for the preinjection the electrically controlled valve is closed and is opened again only to end the main injection.

2. The fuel injection system according to claim 1, in which as the injection valve, the injection valve serves to subdivide the injection into various injection rates is, with an opening cross section that is adjustable in two stages by the injection valve member.

3. The fuel injection system according to claim 2, in which the injection valve has at least first and second closing springs, and the valve member, by means of the delivered high fuel pressure counter to said closing force of said first spring, executes a first opening force for the preinjection, and after that counter to the force of the first and/or a further spring executes a further opening stroke in order to perform the main injection.

4. The fuel injection system according to claim 1, in which a distributor injection pump acts as the fuel injection pump.

* * * * *